United States Patent [19]

Tsunoo et al.

[11] B 3,999,456

[45] Dec. 28, 1976

[54] VOICE KEYING SYSTEM FOR A VOICE CONTROLLED MUSICAL INSTRUMENT

[75] Inventors: Masahiko Tsunoo, Suita; Kinji Kawamoto, Kyoto, both of Japan

[73] Assignee: Matsushita Electric Industrial Co., Ltd., Osaka, Japan

[22] Filed: June 4, 1974

[21] Appl. No.: 476,568

[44] Published under the second Trial Voluntary Protest Program on March 16, 1976 as document No. B 476,568.

[52] U.S. Cl. ..... 84/1.01; 84/1.03

[51] Int. Cl.[2] ..... G10H 1/00; G10H 5/02

[58] Field of Search ..... 84/1.01, 1.24, 1.02, 84/1.03, 1.28, DIG. 30

[56] References Cited

UNITED STATES PATENTS

| | | | |
|---|---|---|---|
| 3,004,460 | 10/1961 | Wayne, Jr. | 84/1.01 |
| 3,007,361 | 11/1961 | Wayne, Jr. | 84/1.01 |
| 3,539,701 | 11/1970 | Milde | 84/1.28 |
| 3,639,853 | 2/1972 | Sakai | 84/1.01 X |
| 3,647,929 | 3/1972 | Milde, Jr. | 84/1.01 |
| 3,651,729 | 3/1972 | Adachi | 84/1.24 X |
| 3,668,294 | 6/1972 | Kameoka et al. | 84/1.01 |
| 3,719,767 | 3/1973 | Matumoto et al. | 84/1.01 |
| 3,743,756 | 7/1973 | Franssen et al. | 84/1.01 |
| 3,767,833 | 10/1973 | Noble et al. | 84/1.01 |
| 3,781,450 | 12/1973 | Nakajima | 84/1.01 |
| 3,842,702 | 10/1974 | Tsundoo | 84/1.01 |

*Primary Examiner*—L. T. Hix
*Assistant Examiner*—Stanley J. Witkowski
*Attorney, Agent, or Firm*—Wenderoth, Lind & Ponack

[57] ABSTRACT

A voice keying system for a voice controlled musical instrument comprising a frequency responding circuit for responding to an input signal of audio frequency and generating a control signal which corresponds to each of a plurality of frequency bands of input signal and also to a plurality of notes of a musical scale, and a tone generator for generating an output tone signal corresponding to each of the notes of the musical scale. The input signal is converted into the output tone signal having a smaller rate of frequency increment than that of the input signal in each of the frequency bands thereof.

22 Claims, 23 Drawing Figures

VOICE KEYING SYSTEM FOR A VOICE CONTROLLED MUSICAL INSTRUMENT

BACKGROUND OF THE INVENTION

This invention relates to a voice controlled musical instrument in which a new output tone signal can be produced thereby from a monophonic melody input signal of audio frequency, such as an input signal created by a vocal tone sung by a man, a sound played by a musical instrument or a musical tone signal of any of audio apparatus, and more particularly to a novel voice keying system for a voice controlled musical instrument, in which any input signal is converted to an output tone signal having a smaller rate of frequency increment than the input signal has, or having a constant frequency in each of differently predetermined frequency bands, so that an output tone signal having stable and accurate frequency is produced from an input signal having unstable and inaccurate frequency.

There have heretofore been proposed some types of voice controlled musical instruments, in which an input signal is converted to a fundamental frequency signal having the frequency proportional to that of the input signal. The fundamental frequency signal is multiplied and/or divided in frequency so as to generate a plurality of octavely related tone signals. The octavely related tone signals are controlled in amplitude envelope in relation to the amplitude envelope of the input signal. Thus, a new output tone signal is produced.

In general because a pitch or interval of a vocal tone sung by a man is inaccurate and unstable, a frequency fluctuation and/or a frequency error of $\pm$ 1 to 2% is inevitable in a vocal tone sung by a man even if he carefully sings.

Such a frequency error or frequency fluctuation can hardly be perceived by any one when the vocal tone is heard directly., However, the frequency error or frequency fluctuation of the output tone signal can be distinctly perceived by any one when he hears a vocal tone processed by a conventional voice controlled musical instrument. Therefore, any music processed by such conventional voice controlled musical instrument is heard poorly against the player's will even if he performs skillfully. Consequently, it is very difficult for a beginner to play such a conventional voice controlled musical instrument and he is required to do many exercises to play it skillfully.

SUMMARY OF THE INVENTION

Therefore, it is an object of the present invention to provide a novel voice keying system for a voice controlled musical instrument, which is very easy to play, in order to remove the defects mentioned hereinbefore.

Another object of the invention is to provide a novel and improved voice controlled musical instrument in which any unstable input signal, not only the vocal tone but also any monophonic tone signal from any musical or audio instrument, can be converted into a stable output tone signal.

These objects can be achieved by providing the voice keying system for a voice controlled musical instrument according to the present invention, which comprises a frequency responding means for responding to an input signal of audio frequency and generating a control signal which corresponds to each of a plurality of frequency bands of input signal, said plurality of frequency bands corresponding to a plurality of notes of a musical scale, respectively, each of said frequency bands having a frequency range which covers approximately a tone interval of a half-tone of said musical scale, and the center frequency of each of said frequency bands being predetermined so as to correspond approximately to the frequency of each of said notes of the musical scale, and a tone generator coupled to the output of said frequency responding means for generating an output tone signal in response to said control signal, said output tone signal corresponding to each of said notes of the musical scale, whereby said input signal is converted into said output tone signal which has a smaller rate of frequency increment than said input signal has in each of said frequency bands thereof.

BRIEF DESCRIPTION OF THE DRAWING

Other objects, features and advantages of the invention will be made clear from the following detailed description of embodiments thereof considered together with the accompanying drawings wherein:

FIG. 5 is a circuit diagram of a further embodiment of the present invention;

DETAILED DESCRIPTION OF THE PREFERRED EMBODIMENT

Figure 1:
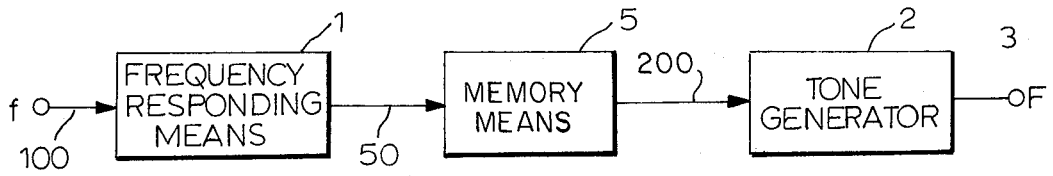
FIG. 1 is a schematic block diagram of a fundamental embodiment of a voice keying system of the present invention.
Figure 2:
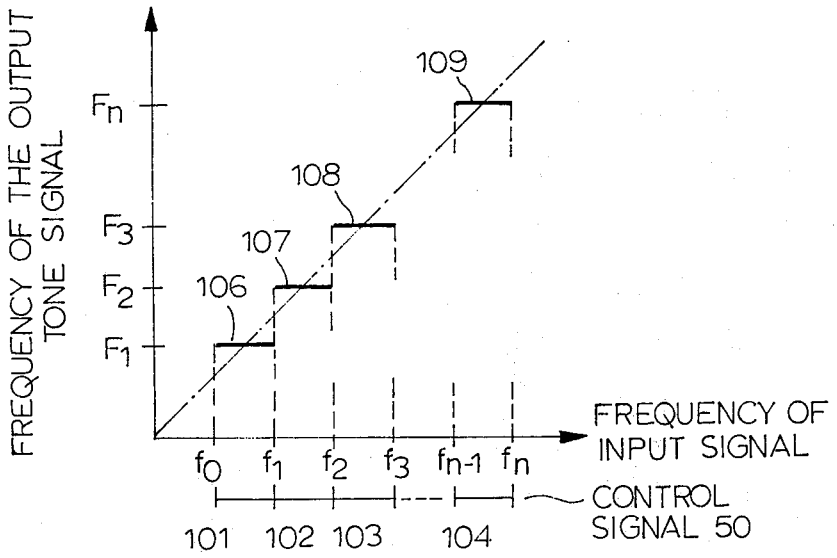

Referring to FIG. 1, a monophonic input signal 100 of audio of frequency *f*, which is produced by a voice, a sound of an instrument or a musical sound of a musical source, is applied to a frequency responding means 1. The frequency responding means 1 generates a control signal 50 in response to the input signal 100 of audio frequency $f$. For example, the control signal 50 can be any of a plurality of control signals 101, 102, 103, . . . , and 104 corresponding to a plurality of differently predetermined frequency bands $fo<f\leqq f_1$, $f_1<f\leqq f_2$, $f_2<f\leqq f_3$, . . . , and $f_{n-1}<f\leqq f_n$ of the input signal, as shown in FIG. 2. These frequency bands correspond to a plurality of notes of a musical scale, respectively. Each of these frequency bands has a frequency range which covers approximately a tone interval of a half-tone of said musical scale. The center frequency of each of these frequency bands is predetermined or tuned so as to correspond approximately to a frequency of each of the notes of the musical scale. This plurality of control signals can be provided (a) from a plurality of different output terminals in the form of voltage signals, (b) from one output terminal in the form of a plurality of different voltages, or (c) from a set of output terminals in the form of different logic codes. The control signal 50 is memorized in a memory means 5 so as to produce a memorized signal 200, and the memorized signal 200 is applied to a tone generator 2. The tone generator 2 generates, in response to the control signal 50, an output tone signal F corresponding to any of output tone signals 106, 107, 108, . . . , and 109 having a predetermined frequency $F_1$, $F_2$, $F_3$, . . . , and $F_n$, respectively at an output terminal 3.

In the voice keying system of the invention, the input signal 100 having the inaccurate frequency $f$ such as $fo<f\leqq f_1$, $f_1<f\leqq f_2$, $f_2<f\leqq f_3$, . . . or $f_{n-1}<f\leqq f_n$ is converted to an output tone signal F having the accurate frequency $F_1$, $F_2$, $F_3$, . . . or $F_n$. The memory means 5 is reset by any remarkable change in the input signal 100 and then memorizes another control signal 50 newly applied thereto so as to produce another memorized signal 200.

Figure 3:
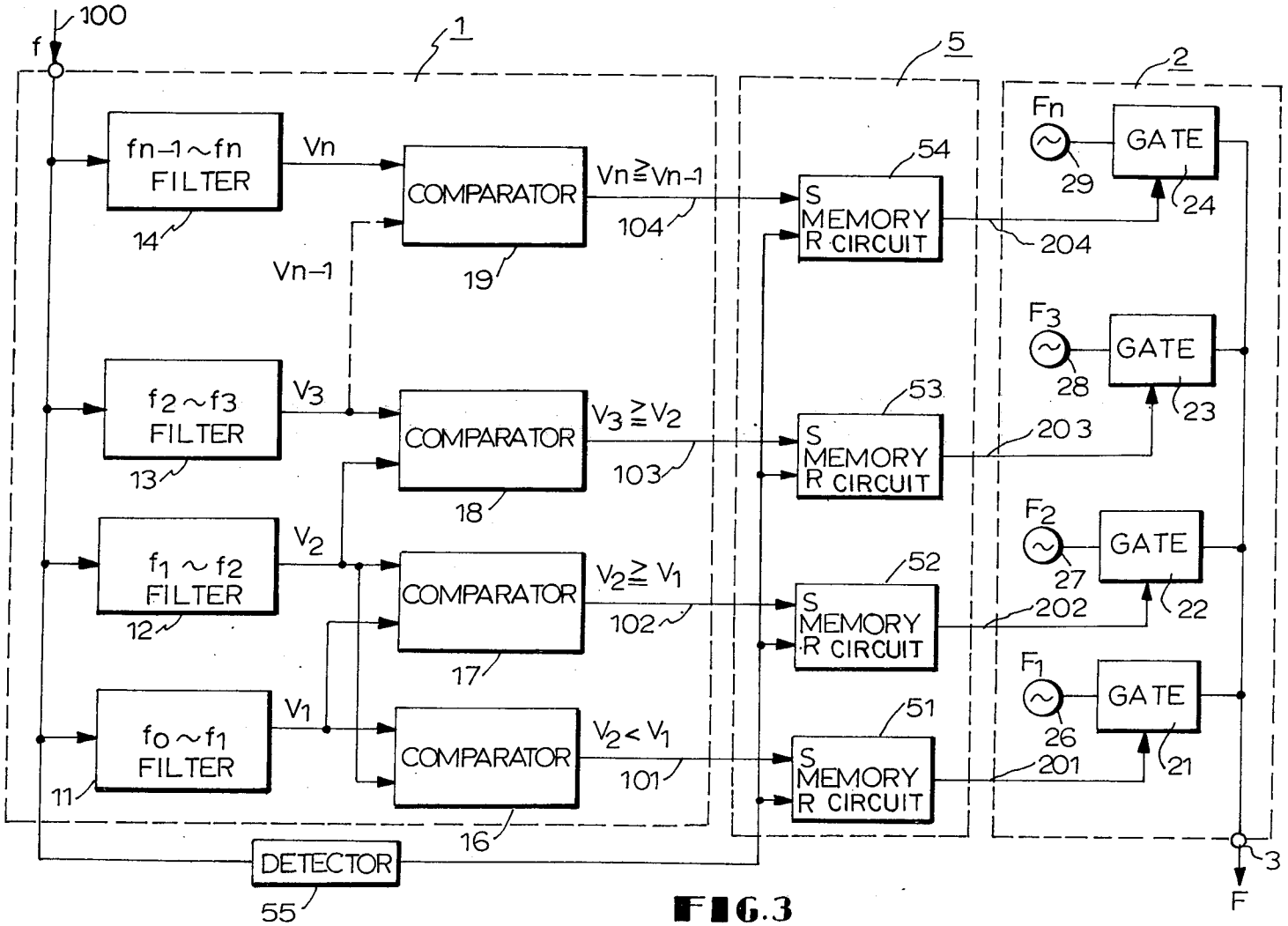
FIG. 3 is a schematic block diagram of another embodiment of a voice keying system of the present invention.

FIG. 3 is a schematic block diagram of another embodiment of the voice keying system of the invention, which corresponds to the case (a) described before wherein the control signals are derived from a plurality of output terminals in the form of voltage signals. The input signal 100 is applied to a plurality of band pass filters 11, 12, 13, . . . and 14 of the frequency responding means 1. The band pass filters 11, 12, 13, . . . and 14 provide, in response to different frequency bands $fo<f\leqq f_1$, $f_1<f\leqq f_2$, $f_2<f\leqq f_3$, . . . and $f_{n-1}<f\leqq f_n$, control voltages $V_1$, $V_2$, $V_3$, . . . and $V_n$, respectively at the output terminals thereof. Control voltages $V_1$, $V_2$, $V_3$. . . and $V_n$ can easily be produced by a conventional circuit in which a.c. voltage is rectified by a rectifier and smoothed by a ripple filter so as to produce d.c. voltage output. Such a circuit is shown, for example, in *Electronic Designer's Handbook*, pages 15-2 to 15-48, written by Robert W. Landee et al. and published by McGraw-Hill Book Company, Inc. in 1957. As these band pass filters do not have ideal characteristics, some outputs which are outside of the respective pass bands may be produced. In order to prevent an erroneous operation, two output voltages from the two band pass filters of adjacent pass bands are compared with each other, and the larger voltage of the two is selected as the control signal 50.

That is, a comparator 16 compares the voltage $V_1$ of the band pass filter 11 with the voltage $V_2$ of the band pass filter 12 and provides a control signal 101 at the output thereof in the case of $V_1>V_2$. A comparator 17 compares similarly the voltage $V_1$ of the band pass filter 11 with $V_2$ of 12 and provides a control signal 102 at the output thereof in the case of $V_2\geqq V_1$. Similarly, a comparator 18 provides a control signal 103 at the output thereof in the case of $V_3\geqq V_2$, and a comparator 19 provides a control signal 104 at the output thereof in the case of $V_n\geqq V_{n-1}$. These output control voltages 101, 102, 103, . . . , and 104 of the comparators 16, 17, 18, . . . , and 19 are applied to set terminals S of the respective memory means 51, 52, 53 . . . 54 and memorized therein in the form of uniform voltages 201, 202, 203, . . . , and 204. These voltages are d.c. voltages and equal to each other. Such uniform or equal voltages can easily be produced by memory means 5 such as S-R Flip-Flop circuits. All of these flip-flop circuits produce voltage outputs equal to each other when set by the outputs of comparators 16, 17, 18 . . . and 19 in the case that they are supplied with equal source voltages.

Output voltages 201, 202, 203, . . . , and 204 of flip-flop circuits, which are memorized therein, are applied to respective gates 21, 22, 23, . . . , and 24, and thereby the signals $F_1$, $F_2$, $F_3$, . . . , and $F_n$ of accurate frequencies from oscillators 26, 27, 28 . . . , 29 are switched on. Then an output tone signal F is provided at the output terminal 3 of the gates 21, 22, 23 . . . , and 24. A detector 55 detects any great frequency change of the input signal 100, such as changes in notes of the musical scale, e.g. from "do" to "re", from "do" to "do-sharp", from "re" to "mi", from "re" to "re-sharp". . . from "do" to "so", from "so" to "do", etc. and generates a reset pulse to be applied to reset terminals R of the memory circuits 51, 52, 53, . . . , and 54. The memory circuits 51, 52, 53, . . . , and 54, are reset by the reset pulse, and then they memorize the next control signals 101, 102, 103, . . . , and 104, again produce uniform voltages 201, 202, 203, and 204.

In FIG. 3, the frequency responding means 1 comprises the band pass filters 11, 12, 13, . . . , and 14 and the comparators 16, 17, 18, . . . , and 19. The memory means 5 comprises the memory circuits 51, 52, 53, . . . , and 54. The tone generator 2 comprises the oscillators 26, 27, 28, . . . , and 29 and the gates 21, 22, 23, . . . , and 24. Each of comparators 16–29 can be a differential comparator SN 52710/SN72710 made by Texas Instruments, Inc. Each of the memory circuit 51 to 54 can be composed of a conventional Flip-Flop circuit of set-reset type. The detector 55 can be for example as shown in FIG. 22, composed of a frequency to voltage converter 310 and a differentiator of the C-R type. The frequency to voltage converter can be a Frequency-to-DC Converter Model 420, 430 or 440 made by Solid State Electronic Corporation.

Figure 4:
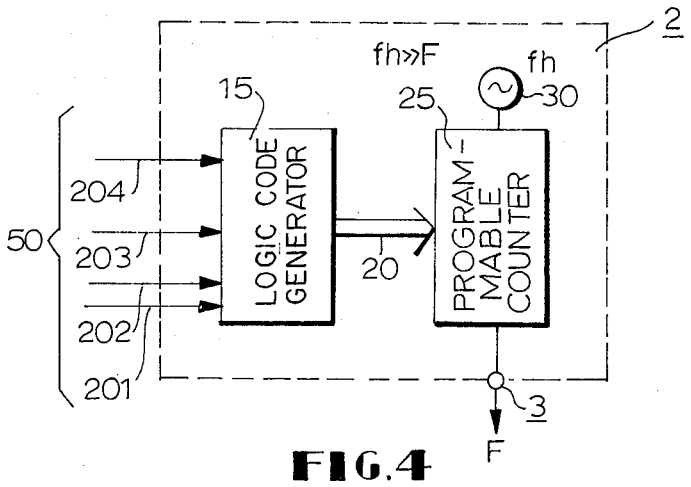
FIG. 4 is a schematic block diagram of an embodiment of a tone generator applicable to the embodiment of FIG. 3.

FIG. 4 is another embodiment of the tone generator 2 which is applicable to the embodiments of FIGS. 1 and 3. Such a logic code generator 15 can be constituted by such a conventional decoder circuit as described in *Designing with TTL Integrated Circuits*, pages 181 to 210, edited by Robert L. Morris et al. and published by McGraw-Hill Book Company, in 1971 or in *Wave Generation and Shaping, pages* 78 to 79, edited by Leonard Strauss and published by McGraw-Hill Book Company in 1960. The logic code 20 is applied to the program terminals of a programmable counter or a variable divider 25 and determines the dividing factor thereof. The programmable counter or the variable divider 25 divides a frequency $f_H$($f_H>>F_1$, $F_2$, $F_3$, . . . , and $F_n$) generated by a high frequency oscillator 30 by that dividing factor, and then it generates in response to the logic code 20 the output tone signal F having a frequency $F_1, F_2, F_3, \ldots$, or $F_n$ corresponding to notes of a musical scale, at the output terminal 3. The programmable counter of the variable divider 25 can be a programmable divider DM 7520/DM 8520 made by National Semiconductor Corporation.

Figure 5:
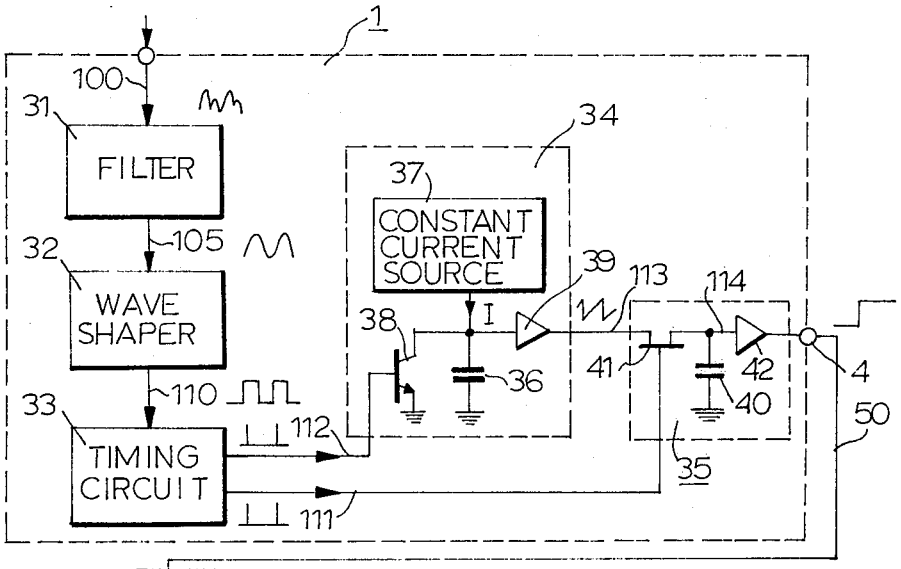
FIG. 5 is a diagram representatively showing a keying characteristic of the voice keying system of FIG. 1.
Figure 5:
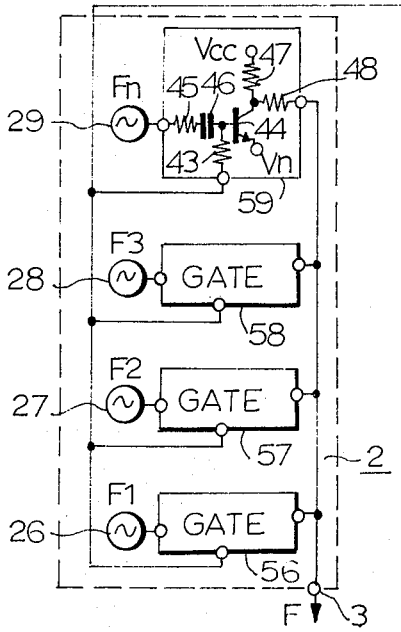

FIG. 5 depicts a further another embodiment of the invention, which corresponds to the case (b) described hereinbefore where the control voltages derived from one output terminal in the form of different voltage ranges which correspond to the frequency bands of the input signal are used as the control signal 50. A low pass filter 31 attenuates harmonic frequency components of the input signal 100 and produces a sine-wave-like signal 105. A wave shaper 32 converts the sine-wave-like signal 105 into a rectangular wave 110, the frequency of which is equal to that of the input signal 100. A timing circuit 33 processes the rectangular wave 110 so as to produce a sampling pulse 111 and reset pulse 112. The sampling pulse 111 has a narrow pulse width and coincides in timing with rise of rectangular wave 110. The reset pulse 112 has also a narrow pulse width and is slightly delayed in timing relative to the sampling pulse.

A sawtooth wave generator 34 generates a sawtooth wave signal 113 having the amplitude proportional to the period of the input signal 100. It comprises a capacitor 36, a constant current source 37 for charging the capacitor 36, a transistor 38 for discharging the capacitor 36 and a buffer amplifier 39. When the reset pulse 112 is applied to the base of the transistor 38, the voltage across the capacitor 36 immediately becomes zero owing to discharge through the collector and the emitter of the transistor 38. After that, the constant current I of the constant current source 37 charges the capacitor 36 so as to produce a ramp voltage across the capacitor 36. On arrival of the next reset pulse 112, the voltage across the capacitor 36 again immediately becomes zero. Thus, such operation is repeatedly performed to coincide with the period of the reset pulse or with the input signal 100 during time the input signal 100 is applied, and there is generated the sawtooth wave signal 113. The amplitude of the sawtooth wave signal 113 is proportional to the period of the reset pulse 112 or the input signal 100, or it is inversely proportional to the frequency of the input signal 100.

The sawtooth wave signal 113 is applied through the buffer amplifier 39 having a high input impedance, to a sample and hold circuit 35. The sample and hold circuit 35 generates, as the control signal 50, a d.c. voltage proportional to the amplitude of the sawtooth wave signal 113. It comprises a capacitor 40 for holding the voltage, an FET 41 for sampling switch and a buffer amplifier 42 having a high input impedance. The sampling pulse 111 switches the FET 41 on, and a voltage corresponding to the amplitude of the sawtooth wave signal 113 is immediately sampled and then the sampled voltage is held across the capacitor 40. Thus, the sample and hold circuit 35 produces the d.c. voltage 114 coinciding with the amplitude of the sawtooth wave signal 113 at the output 4 of buffer amplifier 42. Consequently, the frequency responding means 1 generates, at the output terminal 4, the d.c. voltage inversely proportional to the fundamental frequency of the input signal 100. For one output terminal 4, the frequency responding means 1 can generate control voltages having different voltage ranges which correspond to a plurality of different frequency bands of the input signal, respectively.

The capacitor 40 of the sample and hold circuit 35 acts as the memory means 5 for memorizing the control signal 50 until another voltage is applied. The memorized control signal is derived through the buffer amplifier 42 from the output terminal 4 thereof, and then it is applied to the tone generator 2. The tone generator 2 generates one tone signal at a time, that is one signal among a plurality of tone signals having different frequencies corresponding to the different control signals. The tone generator 2 comprises, as shown in FIG. 5, a plurality of oscillators 26, 27, 28, . . . , and 29 and a plurality of gates 56, 57, 58, . . . and 59.

Figure 6:
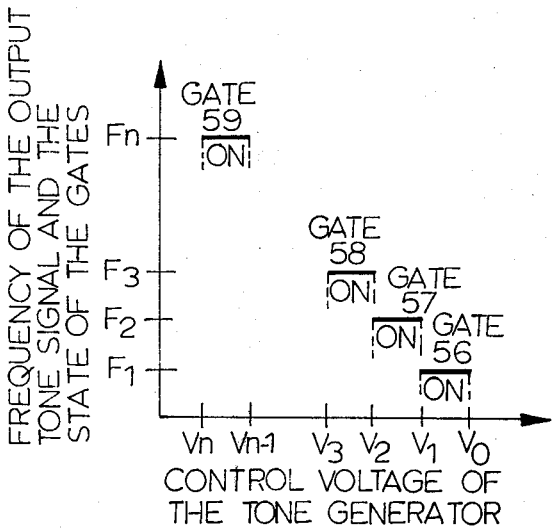
FIG. 6 is a diagram showing a control characteristic of the tone generator used in FIG. 5.

The gates 56, 57, 58, . . . , and 59 are opened, as shown in FIG. 6, in response to a plurality of different ranges $V_o > V \geqq V_1$, $V_1 > V \geqq V_2$, $V_2 > V \geqq V_3, \ldots$, and $V_{n-1} > V \geqq V_n$ of the control voltage V of the control signal 50, and the respective output tone signals $F_1, F_2, F_3, \ldots$, and $F_n$ are produced at the output terminal 3.

The construction of the gate 59 is shown in FIG. 5 by way of example. The control voltage is applied to a base of a transistor 44 through a base resistor 43. The signal $F_n$ of the oscillator 29 is also applied to the base of the transistor 44 through a series circuit of a resistor 45 and a capacitor 46. The collector of the transistor 44 is connected to a voltage source +Vcc through a collector resistor 47 and is also connected to the output terminal 3 through an output resistor 48. The emitter of the transistor 44 is connected to a bias voltage source $V_n$.

When the control voltage is below the voltage $V_n$, the transistor 44 is cut off and cannot transmit the signal $F_n$ from the base to the output terminal 3. When the control voltage is between voltages $V_n$ and $V_{n-1}$, the transistor becomes active and can transmit the amplified signal $F_n$ from the base to the output terminal 3. When the control voltage is beyond the voltage $V_{n-1}$, the transistor 44 is saturated and cannot transmit the signal $F_n$ from the base to the output terminal 3 because of by pass from the base to the emitter bias source $V_n$. The other gates are constructed similarly to the gate 59. In this case, the resistances of the resistors 43 and 47 are arranged so as to saturate the transistors of these gates at the control voltages $V_o, V_1, V_2, \ldots$, and $V_{n-1}$, where $V_o > V_1 > V_2 > V_3 > , \ldots, > V_{n-1} > V_n$.

Figure 7A:
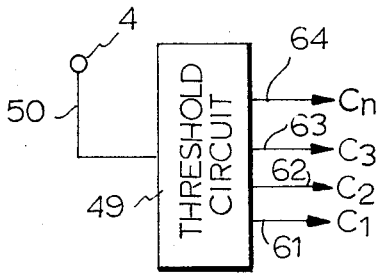
FIGS. 7 (*a*) and (*b*) are a circuit diagram and a diagram of operating characteristic of a threshold circuit applicable to a modified embodiment of FIG. 5, respectively.
Figure 7B:
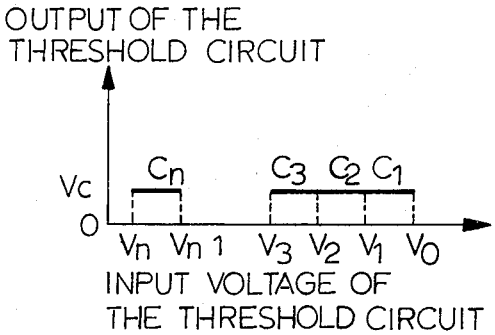

FIG. 7(*a*) is a circuit diagram of a threshold circuit applicable to a modified embodiment of FIG. 5. A threshold circuit 49 processes the output control signal 50 so as to produce voltage signals $C_1, C_2, C_3, \ldots$, and $C_n$ of equal voltage $V_c$, as shown in FIG. 7(*b*), at different output terminals 61, 62, 63, . . . , and 64. Such a threshold circuit 49 can be constituted for example, by modification of the amplitude classifier described in *Operational Amplifiers*, pages 366 to 368, edited by Herald G. Graeme et al. and published by McGraw-Hill Book Company in 1971. These voltage signals $C_1, C_2, C_3, \ldots$, and $C_n$ correspond to different voltage ranges $V_o > V \geqq V_1$, $V_1 > V \geqq V_2$, $V_2 > V \geqq V_3, \ldots$, and $V_{n-1} > V \geqq V_n$ of the input voltage of the threshold circuit 49. By applying these voltage signals to the encoder 15 of FIG. 4, there is provided the logic code 20 in response to each of these signals $C_1, C_2, C_4, \ldots$, and $C_n$. The programmable counter or the variable divider 25 responds, in as FIG. 4, to the logic code 20 and generates, at the output terminal 3 thereof, the output tone signal F having the frequency $F_1, F_2, F_3, \ldots$, or $F_n$ corresponding to the voltage signals $C_1, C_2, C_3, \ldots$, and $C_n$, respectively. The tone generator 2 of FIG. 3 can be controlled by these voltage signals $C_1, C_2, C_3, \ldots$, and $C_n$ so as to generate the output tone signal F having the frequency $F_1$, $F_2$, $F_3$, . . . . or $F_n$.

Figure 8:
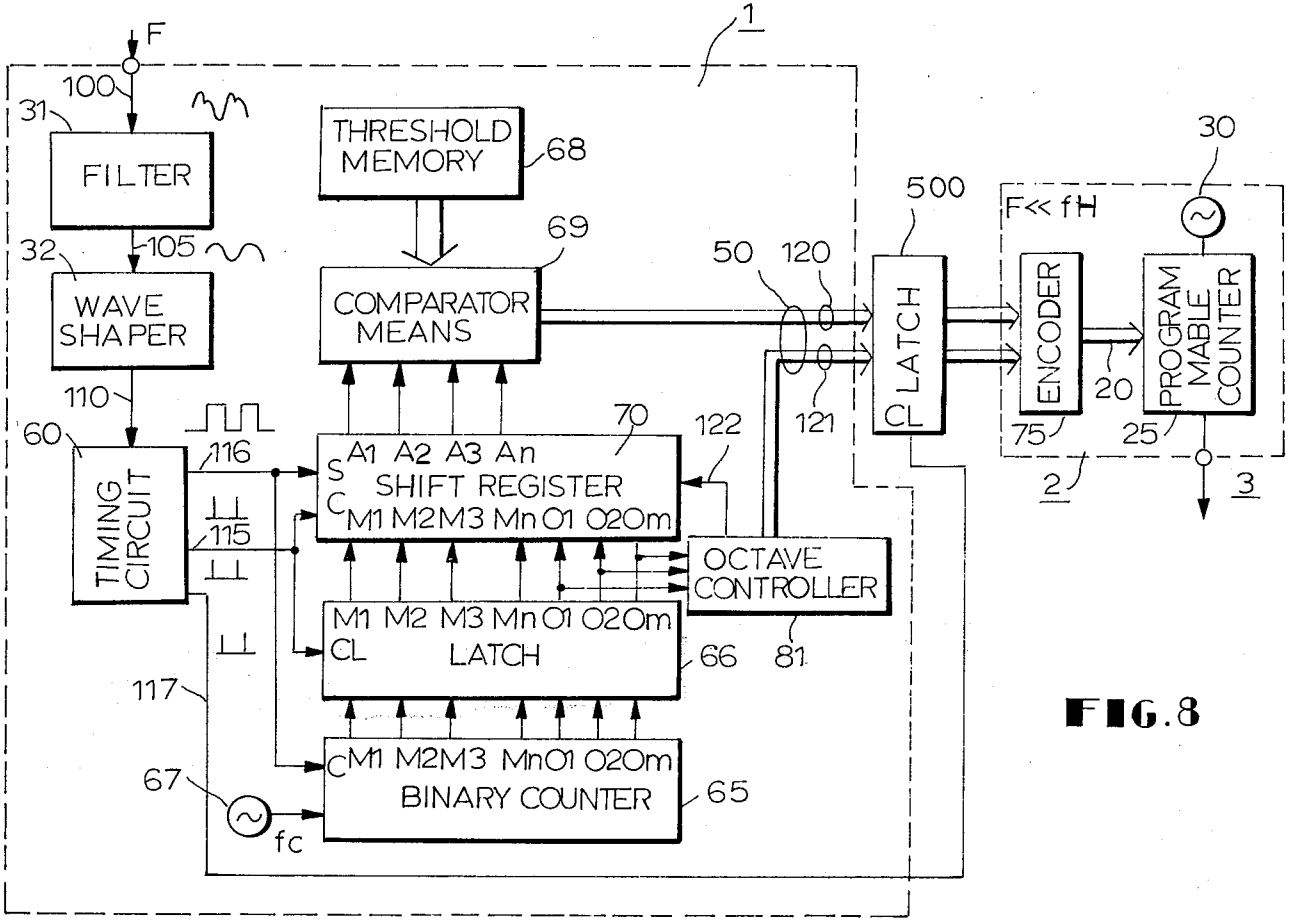
FIG. 8 is a schematic block diagram of a still further embodiment of the present invention.

FIG. 8 is a schematic block diagram of a further embodiment of the invention, which corresponds to the case (c) described herein-before that the control signal 50 is derived from a set of output terminals in a form of different logic codes. The low pass filter 31 attenuates, as well as in FIG. 5, harmonics frequency components of the input signal 100 and produces the sine-wave-like signal 105. The wave shaper 32 converts the sine-wave-like signal 105 into a rectangular wave 110, frequency of which is equal to that of the input signal 100. A timing circuit 60 processes the rectangular wave 110 so as to produce three pulses 115, 116 and 117 each having a narrow pulse width, which is preferably narrower than the period of the signal of a high frequency oscillator 67 described hereinafter. The pulse 115 coincides in timing with the rise of the rectangular wave 110. The pulse 116 is generated immediately after the pulse 115 ceases, and the pulse 117 is generated immediately after the pulse 116 ceases. Such a timing circuit can easily be constructed by a man ordinarily skilled in the art of digital circuits, so that a detailed description thereof is omitted here. The pulse 115 is applied at a clear terminal C of a shift register 70 and to a clock terminal CL of a latch 66. The pulse 116 is applied to a set terminal S of the shift register 70 and to a clear terminal C of a binary counter 65. The pulse 117 is applied to a clock terminal CL of a latch 500 which is a kind of memory means 5. The timing circuit 60 can be composed in the same manner as the timing circuit 33 shown in FIG. 25.

The binary counter 65 is $n+m$ bits counter, and it starts to operate immediately after is cleared by the pulse 116 so as to count a pulse signal $f_c$ of the high frequency oscillator 67 ($f_c >> F_1, F_2, F_3, \ldots$ and $F_n$). The binary counter 65 counts the number of pulses of pulse signal $f_c$ during one period of the input signal 100 and generates a logic code $M_1\ M_2\ M_3 \ldots Mn\ O_1\ O_2 \ldots O_m$ at the binary output terminals of $n+m$ bits. The binary counter 65 can be one or more 4-Bit Binary Counters SN 5493/SN 7493 made by Texas Instruments, Inc. The latch 66 accepts the logic code $M_1\ M_2\ M_3 \ldots M_n O_1 O_2 \ldots O_m$ of $n+m$ bits from the binary counter 65 and temporarily memorizes this logic code which corresponds to the number of pulses in one period of the input signal 100. The latch 66 can be one or more 8-Bit Bistable Latches SN 54100/SN 74100 made by Texas Instruments, Inc. The count of the binary counter or the latch becomes larger in accordance with increase of the period of the input signal 100. The output logic code $M_1\ M_2\ M_3 \ldots M_n\ O_1\ O_2 \ldots O_m$ of the latch 66 is applied to parallel data input terminals of the shift register 70, and then it is written and memorized in the shift register 70 on application of the pulse 116. The shift register 70 can be one or more 8-Bit Shift Registers SN 54198/SN 74198 made by Texas Instruments, Inc.

A higher order m bits logic code $O_1\ O_2 \ldots O_m$ of the latch 66 is applied to an octave controller 81. The octave controller 81 detects logic 1 which is in the highest order among the bits of logic code $O_1\ O_2 \ldots O_m$, and then generates shift information 122 comprising a shift left signal and shift pulses of $i$ ($i = 0, 1, 2, \ldots, m$) when the highest order logic 1 among the logic code $O_1\ O_2 \ldots O_m$ appears at the $i$-th position counted from the lowest logic bit $O_1$. The octave controller 81 also generates octave information 121 indicating that the frequency of the input signal 100 is in the $i$-th octave from the highest octave. The octave information 121 may be of m sets of $j$ bits code $j = 1, 2, \ldots, m$ or of a single logic 1 at the $i$-th output terminal of m output terminals.

The shift information 122 drives the shift register 70 so as to shift the logic code memorized in the shift register 70 by $i$ bits to the lower order. As an interval of a two tone signal of $i$ octaves corresponds to a frequency ratio of $2^i$ or a frequency ratio of $2^{-i}$, such an interval is indicated by an $i$ bits right or left shift of a binary code. Therefore, a difference of $i$ octaves can be processed by an $i$ bits right or left shift of a binary code in the shift register 70. Thus, the shift register 70 produces, at output terminals of lower n bits in parallel, a logic code $A_1\ A_2\ A_3 \ldots A_n$ corresponding to the input signal 100, but having no relation to any octaves of the input signal 100. In other words, the logic code $A_1\ A_2\ A_3 \ldots A_n$ is quite equal with respect to any two input signals differing by one or more octaves from each other, and so indicates information as to a note of the musical scale within one octave. The control signal 50 comprises the logic code $A_1\ A_2\ A_3 \ldots A_n$ and the octave information.

The octave controller 81, for example, can be easily composed of a priority encoder and a shift pulse generator, which are generally used in a digital processing system. The priority encoder can be a 10-Line-to-4-Line Priority Encoder SN 54147/SN 74147 or an 8-Line-to-3-Line Priority Encoder SN 54148/N 74148 made by Texas Instruments, Inc. The shift pulse generator can easily be constructed by a man ordinarily skilled in the art of digital circuits, so that a detailed description thereof is omitted. The priority encoder generates the octave information 121,i.e. 121, logic code, corresponding to the octave $i$ of the input signal 100, and also controls the shift pulse generator so as to generate shift pulses of $i$.

A threshold memory 68 is a kind of read only memory memorizing previously 12 sets of logic codes $B_1$, $B_2$, $B_3, \ldots B_{12}$ corresponding to boundary frequencies (or periods) of 12 notes of the musical scale within one octave.

Figure 9:
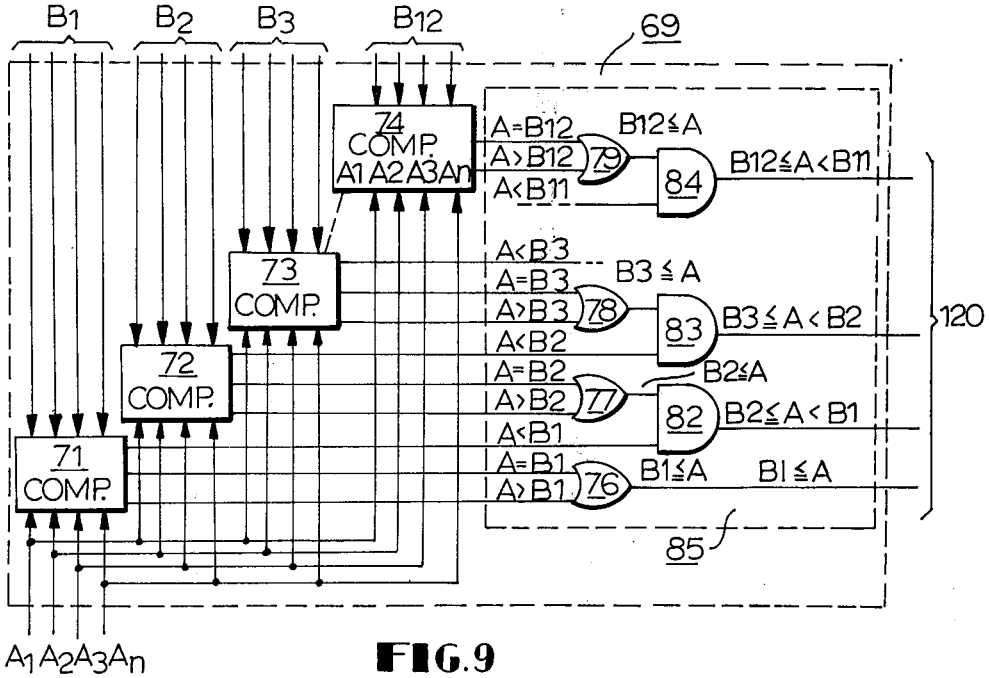
FIG. 9 is a circuit diagram of an embodiment of a comparator used in FIG. 8.

A comparator means 69 comprises, as shown in FIG. 9, twelve sets of comparators 71, 72, 73, . . . , and 74, each of which is of $n$ bits and a combinational logic circuit 85, which comprises OR gates 76, 77, 78, . . . and 79 and AND gates 82, 83, . . . and 84 and which produce a set of musical scale informations 120 corresponding to twelve notes of the musical scale. The comparators 71, 72, 73 and 74 can be one or more 4-Bit Magnitude Comparators SN 5485/SN 7485 made by Texas Instruments, Inc. The comparator 71 compares the $n$ bits musical scale information $A(=A_1\ A_2\ A_3 \ldots A_n)$ of the shift register 70 with the $n$ bits threshold information $B_1$ of the threshold memory 68, and then produces three output signals at respective output terminals thereof in accordance with three possible cases: $A<B_1$, $A=B_1$, and $A>B_1$. Similarly, the comparators 72 and 73 compare the musical scale information A with the threshold information $B_2$ and $B_3$, respectively, and then produce three output signals at respective output terminals thereof in accordance with three possible cases: $A<B_2$, $A=B_2$, $A>B_2$, and $A<B_3$, $A=B_3$ and $A>B_3$, respectively. The comparator 74 similarly compares A with $B_{12}$, and then produces two output signals at respective output terminals thereof in accordance with two possible cases: $A=B_{12}$, and $A>B_{12}$ The OR gates 76, 77, 78 . . . , and 79 and the AND gates 82, 83, . . . . . and 84 produce, in form of the combination of their outputs, the musical scale information 120 corresponding to any one of the 12 notes of the musical scale. The OR gates 76, 77, 78, . . . , and 79 process each set of two outputs $A>B_1$ and $A=B_1$, $A>B_2$ and $A=B_2$, $A>B_3$ and $A=B_3$, . . . , and $A>B_{12}$ and $A=B_{12}$ of the comparators 71, 72, 73, . . . , and 74, and produce outputs corresponding to $B_1 \leqq A$, $B_2 \leqq A$, $B_3 \leqq A$, . . . , and $B_{12} \leqq A$ at the output terminals thereof, respectively. The AND gate 82 processes a remainder output $A<B_1$ of the comparator 71 and the output $B_2 \leqq A$ of the OR gate 77 and produces an output corresponding to $B_2 \leqq A<B_1$. The AND gate 83 processes a remainder output $A<B_2$ of the comparator 72 and the output $B_3 \leqq A$ of the OR gate 78 and produces an output corresponding to $B_3 \leqq A<B_2$. The AND gate 84 processes a remainder output $A<B_{11}$ of a comparator previous to the comparator 74 and the output $B_{12} \leqq A$ of the OR gate 79 and produces an output corresponding to $B_{12} \leqq A<B_{11}$. These outputs corresponding to $A \geqq B_1$, $B_1>A \geqq B_2$, $B_2>A \geqq B_3$, . . . , and $B_{11}>A \geqq B_{12}$ are applied to and memorized in the memory means 5 of a $(12+j)$ bits latch, together with the octave information 121 of $j$ bits $(i \leqq j \leqq m)$ of the octave controller 81. The 12 bits correspond to the 12 notes C, C , D, D#, E, F, F#, G, G#, A, A# and B of musical scale.

The memory means 5 is refeshed by the control signal 50 comprising such musical scale information 120 of 21 bits and octave information 120 of $j$ bits applied thereto each time when the pulse 117 is applied to the clock terminal CL thereof. The output of the memory means 5 is applied to an encoder 75 similar to the encoder 15 of FIG. 4 and it is encoded to a logic code 20 corresponding to the control signal 50 comprising the musical scale information 120 and the octave information 121. The logic code 20 is applied to the program terminals of the programmable counter or the variable divider 25 so as to determine the dividing factor thereof. The programmable counter 25 divides the frequency $F_H$ ($F_H>>F_1, F_2, F_3, \ldots$, and $F_n$) of the high frequency oscillator 30 in accordance with this dividing factor, and generates any one of frequency signals 106, 107, 108, . . . , and 109 having frequencies $F_1, F_2, F_3, \ldots$, and $F_n$ corresponding to the 12 notes of the musical scale, as an output tone signal F at the output terminal 3.

Figure 10:
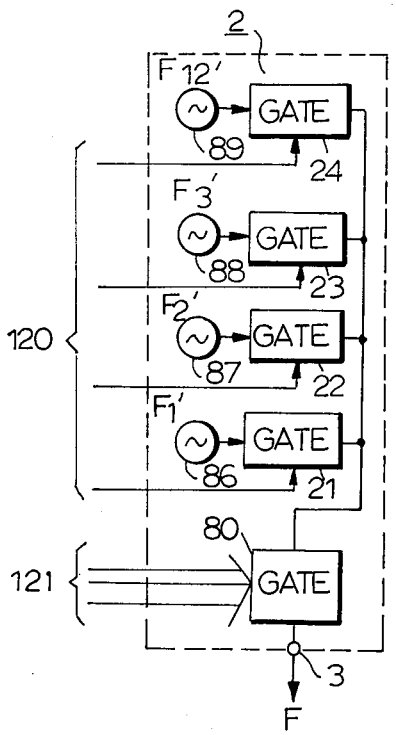
FIG. 10 is a circuit diagram of another embodiment of tone generator applicator to the embodiment of FIG. 8.

The tone generator 2 of FIG. 8 may be replaced with a tone generator 2 shown in FIG. 10, wherein the musical scale signal 120 from the memory means 5 is applied to the control terminals of the gates 21, 22, 23, ..., and 24 so as to switch on signals $F_1'$, $F_2'$, $F_3'$,..., and $F_{12}'$ of oscillators 86, 87, 88, ..., and 89 corresponding to the 12 notes of the musical scale. Only one gate among the gates 21, 22, 23, ..., and 24 is switched on, so that only one output signal from these gates is divided in frequency by the frequency divider 80. The octave information 121 determines the divider stages of the frequency divider 80 in accordance therewith. Each of the stages divides the input frequency by a factor of two. The frequency divider 80 divides one of the frequencies $F_1'$, $F_2'$, $F_3'$, ..., and $F_{12}'$ in accordance with the octave information 121 and produces an output tone signal F having any one of frequencies $F_1$, $F_2$, $F_3$,..., and $F_n$ at the output terminal 3.

Figure 11:
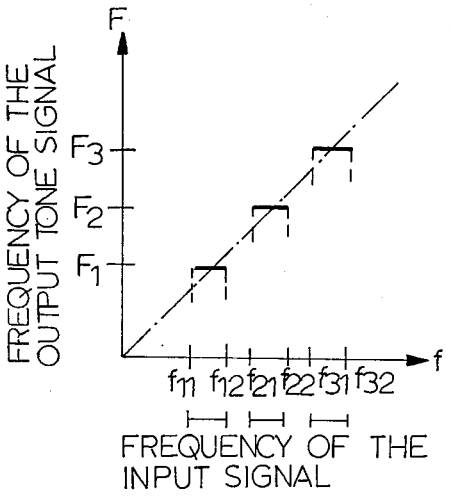
FIGS. 11 and 12 are diagrams showing other keying characteristics of the voice keying system of the present invention.
Figure 12:
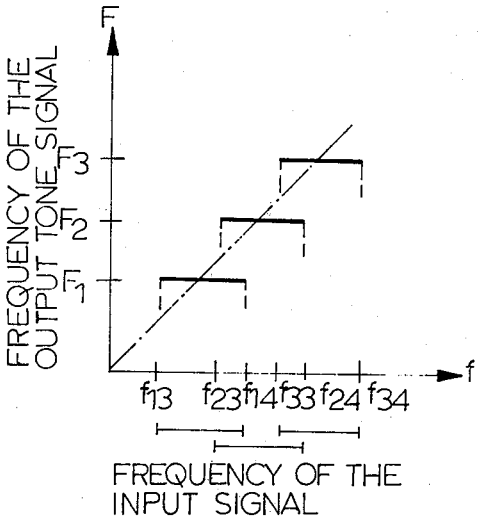

The keying characteristic of the voice keying system of the invention may be arranged as shown in FIG. 11 or 12, instead of the characteristic shown in FIG. 2. The voice keying system having the keying characteristic of FIG. 11 can generates output tone signals F of $F_1$, $F_2$ and $F_3$ in the frequency ranges $f_{11}$ to $f_{12}$, $f_{21}$ to $f_{22}$ and $f_{31}$ to $f_{32}$ respectively, but never generate any output tone signals in the frequency ranges $f_{12}$ to $f_{21}$ and $f_{22}$ to $f_{31}$. The voice keying system having the characteristic of FIG. 12 can also generate output tone signals F of $F_1$, $F_2$ and $F_3$ in the frequency ranges $f_{13}$ to $f_{14}$, $f_{23}$ to $f_{24}$ and $f_{33}$ to $F_{34}$, respectively, and can generate two output tone signals ($F_1$ and $F_2$) and ($F_2$ and $F_3$) in the frequency ranges $f_{23}$ to $f_{14}$ and $f_{33}$ to $f_{24}$, respectively.

The keying characteristic of FIG. 11 can be realized by designing the band pass filters 11, 12, 13, ..., and 14 of FIG. 3 so that their respective pass bands never overlap each other. The keying characteristic of FIG. 12 can be realized by designing the band pass filters 11, 12, 13, .... and 14 of FIG. 3 so that their pass bands overlap each other and by removing the comparators 16, 17, 18, ..., and 19. In this case, the outputs of the band pass filters can be directly used as the control signal 50. The keying characteristic of FIG. 11 can also be realized with the circuit of FIG. 5 by designing the emitter bias voltages or the resistance of the base resistor 43 so that the ranges of the control voltages never overlap each other. Also, the characteristic of FIG. 12 can be realized with the circuit of FIG. 5 by designing the emitter bias voltages or the resistance of the base resistor 43 so that the ranges of the control voltages overlap each other.

The voice keying system of FIG. 8 can be also arranged to have such keying characteristics as shown in FIG. 11 and FIG. 12, although the system may be more complicated than the system of FIG. 3 or FIG. 5. In FIG. 8, the threshold memory 68 may provide units of threshold information, each having both an upper limit and a lower limit for each of twelve notes, and the comparator means 69 may have two comparators for each of twelve notes so as to compare the output logic code $A_1$ $A_2$ $A_3$... $A_n$ with said threshold information of having the upper and lower limits. The keying characteristic of FIG. 11 can be realized when the various units of threshold information do not overlap each other or have a dead zone between two adjacent units of threshold information. The keying characteristic of FIG. 12 can be realized when the various units of threshold information overlap each other between two adjacent unit of threshold information.

The voice keying system of the invention described hereinbefore can multiply or divide the frequency of the input signal so as to produce an output tone signal F multiplied or divided in frequency.

Figure 13:
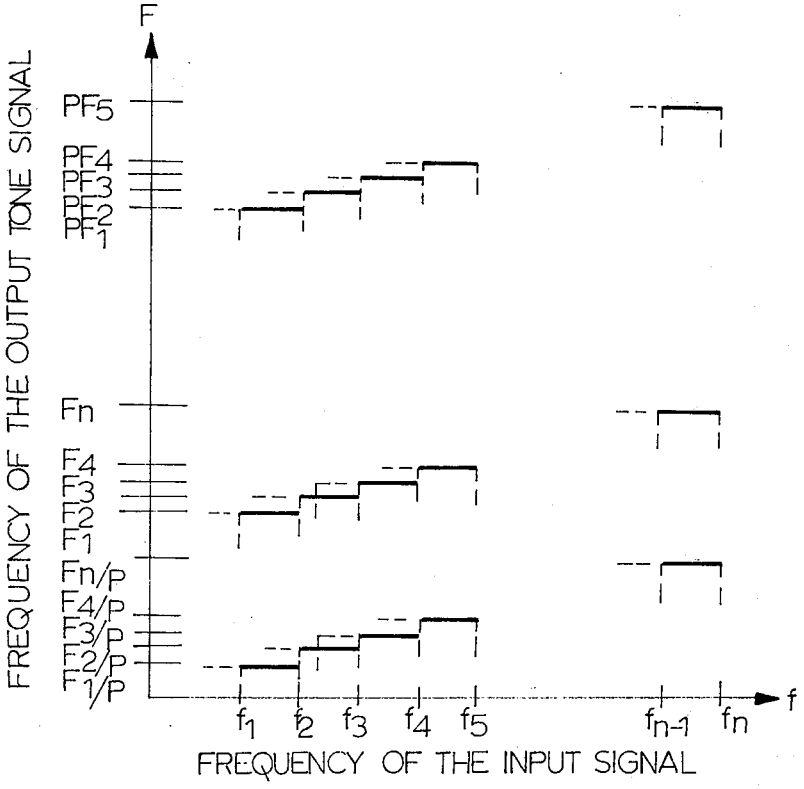
FIG. 13 is a diagram showing keying characteristics of the voice keying system of the present invention when it is used both as a frequency multiplier and a frequency divider as well as the very voice keying system.

That is, the keying system can act as a frequency multiplier or a frequency divider so as to produce multiplied frequencies $PF_1$, $PF_2$, $PF_3$, $PF_4$, ..., $PF_n$ or divided frequencies $F/P_1$, $F/P_2$, $F/P_3$, $F/P_4$,..., and $F/P_n$, when the frequencies $F_1$, $F_2$, $F_3$, $F_4$,..., and $F_n$ of the output tone signal F are nearly P-multiple of 1/P-multiple of the frequencies of the input signal as shown by the keying characteristic of FIG. 13.

In the embodiment of FIG. 3, the oscillators 26, 27, 28, ..., and 29 may be previously adjusted so as to generate frequencies of P-multiple of 1/P-multiple of the frequencies $F_1$, $F_2$, $F_3$, ..., and $F_n$. Or, they may be previously adjusted so as to generate frequencies of P-multiple of the frequencies $F_1$, $F_2$, $F_3$,..., and $F_n$, and then the output tone signal is divided in frequency by an additional frequency divider by a desired factor.

In the embodiment of FIGS. 4 and 8, the high frequency oscillator 30 may be previously adjusted so as to generate a frequency of P-multiple of 1/P-multiple of the frequency $F_H$. Or, it may be previously adjusted so as to generate a frequency of P-multiple of the frequency $F_H$, and then the output tone signal from the output terminal 3 is divided by an additional frequency divider having a desired factor. Thus, the output tone signal having a frequency PF or F/P can be generated at the output terminal 3. In the case when only a divided signal is required, the output tone signal F of the output terminal 3 may be divided by an additional frequency divider so as to generate a divided signal F/P, in FIGS. 3, 4, 5 and 8.

The embodiments of the voice keying system described hereinbefore are represented as a system which can convert the input signal having frequency fluctuation and/or unexact frequency into an output tone signal F having a constant and exact frequency in each of predetermined nonoverlapping frequency bands. However, the objects of the invention can be achieved even by a voice keying system which converts the input signal having frequency fluctuation and/or inexact frequency into an output tone signal having a smaller rate of frequency increment than the input signal in each of differently predetermined frequency bands of the input signal.

Figure 14:
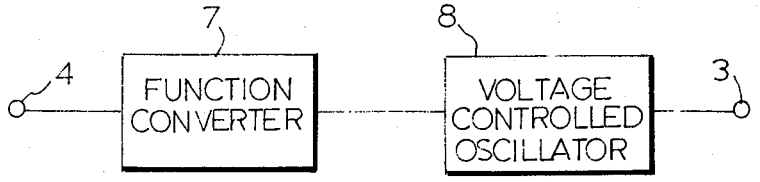
FIG. 14 is a schematic block diagram of a still further embodiment of the present invention.

FIG. 14 is a part of a block diagram of an embodiment of such a voice keying system. The output control voltage 50 of the output terminal 4 of the frequency responding means 1 of FIG. 5, for example, is applied to a control terminal of a voltage controlled oscillator 8 through a function converter 7. The frequency of the voltage controlled oscillator 8 is set to be proportional to the input control voltage at the control terminal.

Figure 15A:
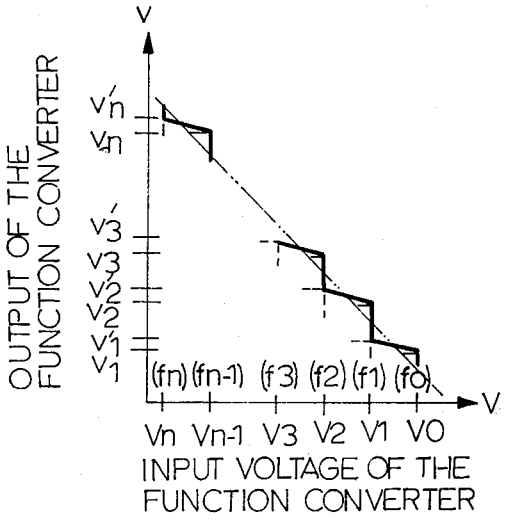
FIGS. 15*a* and 15*b* and 16 and *a* and 16*b* are diagrams of control characeristics of the voice keying system of FIG. 14.
Figure 15B:
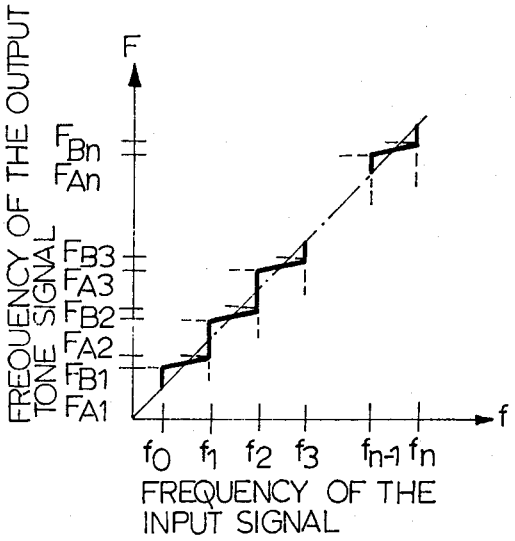

When the function converter 7 has a voltage converting characteristic as shown in FIG. 15 (*a*), the voltage controlled oscillator 8 generates an output tone signal having frequency F as shown in FIG. 15(*b*). The input signal 100 of an inaccurate frequency f, which is indicated by the frequency range $f_0<f\leqq f_1$, $f_1<f\leqq f_2$, $f_2<f\leqq f_3$,..., or $f_{n-1}<f\leqq f_n$ is processed through the frequency responding means and a control voltage V is generated, which is indicated by the control voltage range $V_0>V\geqq V_1$, $V_1>V\geqq V_2$, $V_2>V\geqq V_3$, ..., or $V_{n-1}>V\geqq V_n$, at the output terminal 4. The control voltage V of the output terminal 4 is processed through the function converter 7 so as to generate an output voltage v which is indicated by the output voltage range $v_1<v\leqq v_1'$, $v_2<v\leqq v_2'$, $v_3<v\leqq v_3'$, ..., or $v_n<v\leqq v_n'$. This is narrower than the control voltage range $V_0>V\geqq V_1$, $\geqq V_1>V\geqq V_2$, $\geqq V_2>V\geqq V_3$, ..., or $V_{n-1}>V\geqq V_n$, respectively. The output voltage $v$ controls the voltage controlled oscillator 8 so as to generate an output tone signal of frequency F, which is indicated by a frequency range $F_{A1}<F\leqq F_{B1}$, $F_{A2}<F\leqq F_{B2}$, $F_{A3}<F\leqq F_{B3}$,..., or $F_{An}<F\leqq F_{Bn}$, at the output terminal 3. Thus, the input signal 100 of frequency $f$, i.e. $f_{i-1}<f\leqq f_i$ ( $i$=1,2,3...), is converted to the output tone signal of frequency F, the range of which is $F_{Ai}<F\leqq F_{Bi}$ ($i$=1,2,3) and the rate of frequency increment of which is smaller than that of the input signal 100, as shown in FIG. 15(b).

Figure 16A:
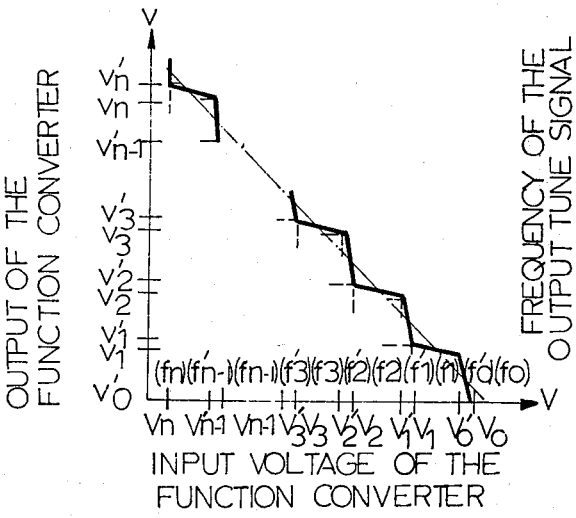
Figure 16B:
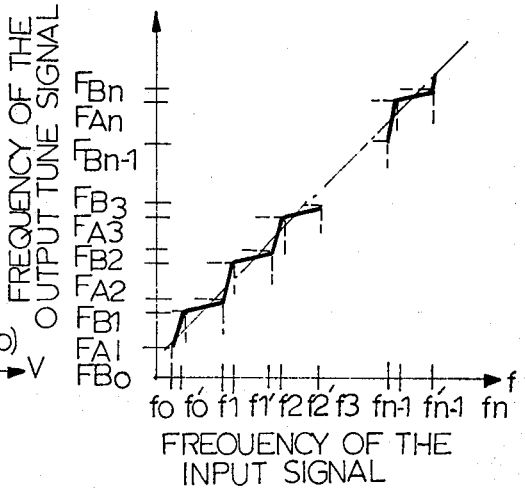

When the function converter 7 has a voltage converting characteristic as shown in FIG. 16(*a*), the voltage controlled oscillator 8 generates an output tone signal having frequency F as shown in FIG. 16(*b*). The input signal 100 of an inaccurate frequency $f$, which is indicated by the frequency range $f_0<f_0'<f\leqq f_1$, $f_1<f_1'<f\leqq f_2$, $f_2<f_2'<f\leqq f_3$, ..., or $f_{n-1}<f_{n-1}'<f\leqq f_n$, generates a control voltage V, which is indicated by the control voltage $V_0>V_0'>V\geqq V_1$, $V_1>V_1'<V\geqq V_2$, $V_2>V_2'>V\geqq V_3$,..., or $V_{n-1}>V_{n-1}'>V\geqq V_n$, at the output terminal 4. The control voltage V of the output terminal 4 is processed through the function converter 7 so as to generate output voltage $v$ which is indicated by the output voltage range $v_0'<v_1<v\quad v_1'$, $v_1'<v_2<v\leqq v_2'$, $v_2'<v_3<v\leqq v_3'$, ..., or $v_{n-1}'<v_n<v\leqq v_n'$. The output voltage $v$ controls the voltage controlled oscillator 8 so as to generate an output tone signal of frequency F, which is indicated by a frequency range $F_{B0}<F_{A1}<F\leqq F_{B1}$, $F_{B1}<F_{A2}<F\leqq F_{B2}$, $F_{B2}<F_{A3}<F\leqq F_{B3}$, ..., or $F_{Bn-1}<F_{An}<F\leqq F_{Bn}$, at the output terminal 3. Thus, the input signal 100 in frequency range $f'_{i-1}<f\leqq f_i$ ($i$=1,2,3...) is converted to the output tone signal of frequency F, the range of which is $F_{Ai}<F\leqq F_{Bi}$ ($i$=1,2,3...) and the rate of frequency increment of which is smaller than that of the input signal 100, as shown in FIG. 16 (*b*). The input signal 100 in a very narrow frequency range $f_{i-1}<f\leqq f_{i-1}'$ ($i$=1,2,3...) is converted to the output tone signal of frequency F, the range of which is $F_{Bi-1}<F\leqq F_{Ai}$ ($i$=1,2,3...). The narrow frequency range $f_{i-1}<f\leqq f'_{i-1}$ is a boundary range between two adjacent input frequency ranges. The staircase-like function generator 7 can conventionally be composed of an operational amplifier, diodes and resistors. Such a circuit is easily constructed, for example, by the technique described in *Operational Amplifiers*, pages 251 to 254, edited by Jerald G. Graeme et al. and published by McGraw-Hill Book Company in 1971.

A function converter having the voltage converting characteristics shown in FIGS. 15(*b*) and 16(*b*) can be easily composed of diodes, resistors, bias voltages and operational amplifiers. Such circuits are conventional and therefore detailed descriptions are deemed unnecessary.

The keying characteristics shown in FIGS. 15(*b*) and 16(*b*) are realized by the digital processing system shown in FIGS. 8 and 9. Subtracting circuits are connected to 12 comparators 71, 72, 73, ..., and 74, respectively. The subtracting circuits subtract the threshold information $B_1$, $B_2$, $B_3$,..., and $B_{12}$ from the logic code A generated by the shift register 70 so as to generate difference codes. These difference codes are applied to the encoder 75 through the latch 500. The encoder 75 processes these difference codes together with the musical scale information 120 and octave information 121 so as to generate output weighted codes. The rate of change of the weighted codes is smaller than that of the difference codes. Each of the weighted codes controls the programmable counter or the variable divider 25, and the programmable counter 25 therefore generates an output tone signal having a rate of the frequency increment smaller than that of the input signal in each of the predetermined nonoverlapping frequency bands of the input signal. By this the keying characteristics of FIGS. 15(*b*) and 16(*b*) are also realized.

The voice keying system having the keying characteristic of FIGS. 15(*b*) or 16(*b*) can be easily prepared, because the system processes the input signal 100 so as to generate an output tone signal having a rate of frequency increment which is much smaller than that of the input signal 100 in each of the nonoverlapping predetermined frequency bands $f_0<f\leqq f_1$, $f_1<f\leqq f_2$, $f_2 < f \leqq f_3, \ldots$, and $f_{n-1} < f \leqq f_n$ (FIG. 15), or in each of the nonoverlapping predetermined frequency bands $f_0' < f \leqq f_1, f_1' < f \leqq f_2, f_2' < f \leqq f_3, \ldots$, and $f'_{n-1} < f \leqq f_n$.

In the voice keying system having keying characteristics as shown in FIGS. 2, 11, 12, 15 and 16, the output tone signal may be switched to and fro between two adjacent frequencies, the signal may never appear, or there may be signals of two adjacent frequencies, when the frequency $f$ of the input signal 100 enters into a boundary range of two adjacent predetermined frequency bands. In such unusual cases the performer can immediately perceive the existance thereof and correct the frequency of the input signal, i.e. the pitch of voice.

The frequencies of the 12 notes of the musical scale are commonly arranged in an equal tempered scale with 440 Hz as the "A" note of middle range. In the voice keying system of the present invention the frequencies of the tone generator 2 and the frequency bands of the frequency responding means 1 may be arranged so that frequencies $F_1, F_2, F_3, \ldots$, and $F_n$ of the signals 106, 107, 108 ... and 109 are equal to such notes of the musical scale. In a music concert or an ensemble however, the frequency of the A note is not always tuned to 440 Hz, but is sometimes tuned to a pitch higher than 440 Hz. When a man sings a song without any accompaniment, the frequency of the A note sometimes deviates from 440 Hz. It is, therefore desirable for the tone generator 2 to be tunable. It is also desirable for the frequency bands of the frequency responding means 1 to be tunable in association with the tuning of the tone generator 2.

Figure 17:
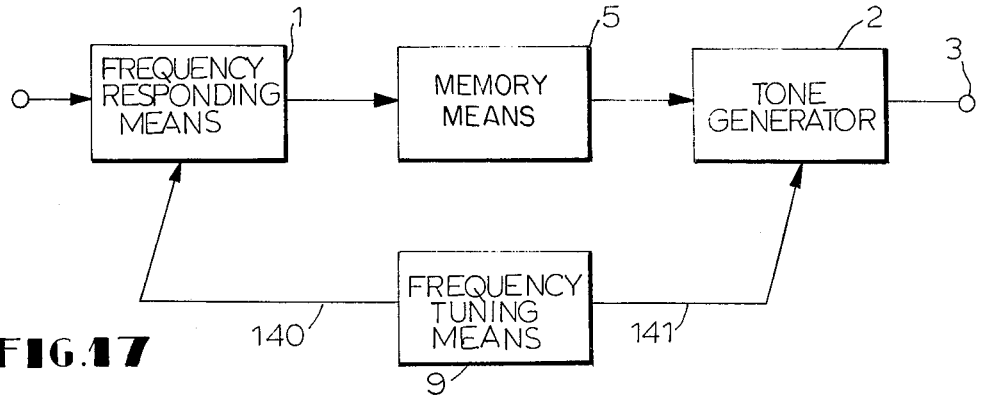
FIGS. 17 to 20 are schematic block diagrams of still further embodiments of the present invention.

FIG. 17 is a block diagram of an embodiment of a voice keying system which is tunable with respect to frequency. A frequency tuning means 9 is additionally coupled both to the frequency responding means 1 and to the tone generator 2 of FIG. 1. Tuning signals 140 and 141 are applied to the frequency responding means 1 and the tone generator 2 so as to tune both the frequency bands of the frequency responding means 1 and the frequencies of the tone generator 2, respectively. In order to apply the frequency tuning means 9 to the embodiment of FIG. 3, variable filters the passband of which can be controlled by voltage may be used as the band pass filters 11, 12, 13, ..., and 14. Such a variable filter can be constructed, for example, by the technique described in the paper entitled "Active RC Filters Containing Periodically Operated Switches" in *IEEE Transactions on Circuit Theory*, Vol. CT-19, No. 3, May 1972, pages 253 to 259, by Kotaro Hirano et al. Voltage controlled oscillators may be used as the oscillators 26, 27, 28, ..., and 29. Such a voltage controlled oscillator can be made of Precision Waveform Generator/-Voltage Controlled Oscillatory 8038 by Intersil, Inc. The output voltages, i.e. the tuning signals 140 and 141, of the frequency tuning means 9 control both the variable filters and voltage controlled oscillators, respectively. In the above case, the frequency tuning means 9 can easily be constituted by a conventional variable d.c. voltage source comprising, for example, a constant d.c. voltage source and a variable potentiometer.

In order to apply the frequency tuning means 9 to the embodiment of FIG. 5, both the collector voltage $Vcc$ of the gates 56, 57, 58, ..., 59 and the emitter bias voltages $V_1$, $V_2$, $V_3$..., and $V_n$ may associatively be varied by the tuning signal 140. The frequencies of the oscillators 26, 27, 28, ..., and 29 may be controlled by the tuning signal 141 similar to the case of FIG. 3. In this case, a variable voltage source may be used as the frequency tuning means 9.

In order to apply the frequency tuning means 9 to the embodiment of FIG. 8, the contents of the threshold memory 68 may be rewritten by the tuning signal 140, and the frequency of the high frequency oscillator 30 may be tuned at the same time by the tuning signal 141. In this case the frequency tuning means may generate, for example, codes for rewriting as the tuning signal 140 and a variable voltage as the tuning signal 141, in association with each other. In order to apply the frequency tuning means 9 to the embodiment of FIG. 8, the frequencies of the high frequency oscillators 67 and 30 may be tuned by the tuning signals 140 and 141 in the same direction of frequency deviation to each other.

In order to apply the frequency tuning means 9 to the embodiment of FIG. 14, the tuning signal 140 may control the staircase like function generator 7 so as to tune the folding points of the staircase function, and the tuning signal 141 may control the voltage controlled oscillator 8 so as to tune the frequency thereof.

Figure 18:
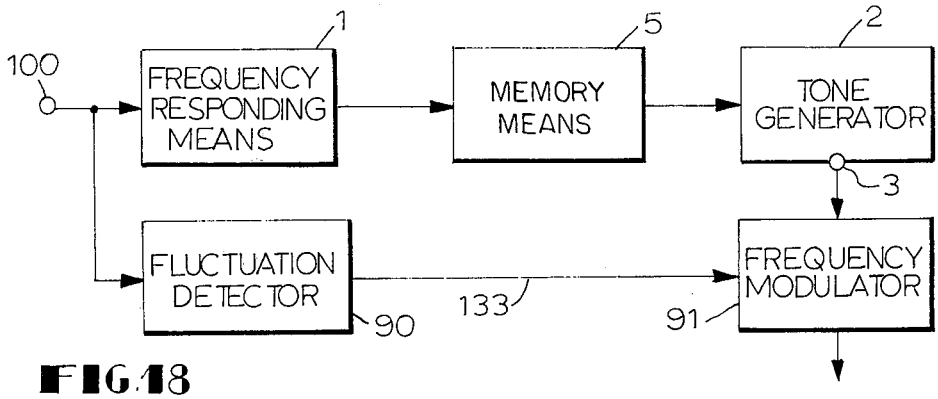

For the application of vibrato as shown in FIG. 18, the voice keying system may further comprise a frequency fluctuation detector 90 for detecting the frequency fluctuation of the input signal 100 and a frequency modulator 91 connected to the output terminal 3 of the tone generator 2 for modulating the frequency of the output tone signal therefrom by the fluctuation signal 133 detected by the frequency fluctuation detector 90. The fluctuation signal 133 may also control the tone generator 2 directly. Thus, a vibrato effect can be achieved in accordance with a vibrato played by a musician, e.g. vibrato of a voice. Such a fluctuation detector can be a Frequency-to-DC Converter Model 420, 430 or 440 made by Solid State Electronics Corporation, which converts the frequency fluctuation into a d.c. voltage fluctuation. The voltage fluctuation can be the fluctuation signal 133. Conventional vibrato effect can, of course, be achieved by application of a conventional vibrato signal to the frequency modulator 91 or the tone generator 2 so as to modulate the frequency of the output tone signal thereof in frequency.

Figure 19:
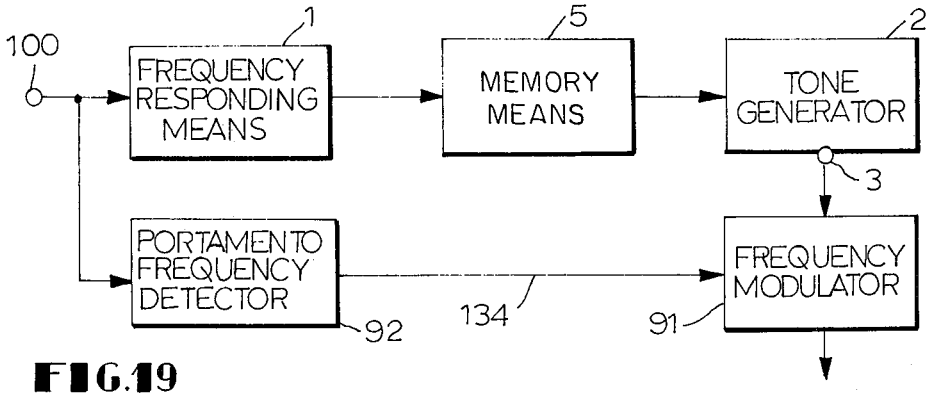
Figure 20:
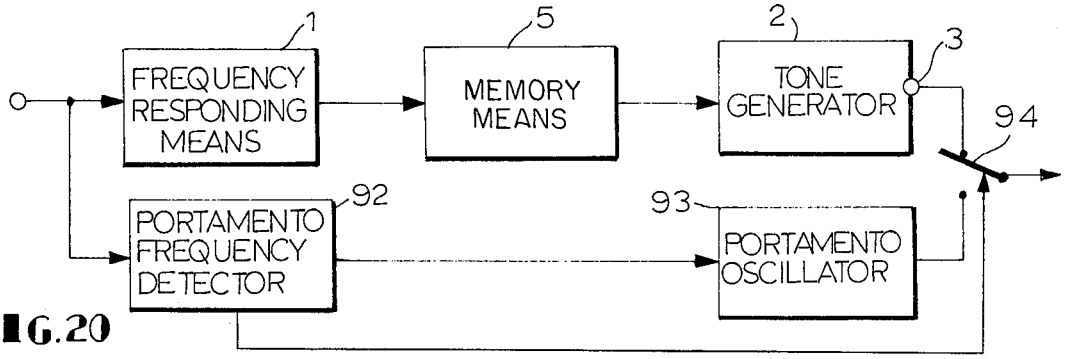

A glissando-like portamento effect can be achieved by mere application of an input signal played by portamento to the input of the voice keying system of the present invention. A portamento effect in a semi-tone or a whole tone can also be achieved by modification of the embodiment of FIG. 18. Such a portamento effect can also be achieved, in the embodiment of FIG. 19, by adding a portamento frequency detector 92 to the embodiment of FIG. 18. The portamento frequency detector 92 detects a portamento frequency so as to control the frequency modulator 91 or the tone generator 2 thereby. The portamento frequency detectors 92 can also be a Frequency-to-DC Converter Model 420, 430 or 440 made by Solid State Electronics Corporation, which converts the frequency change during a portamento into d.c. voltage change. The d.c. voltage change controls the frequency modulator 91 as a portamento control signal 134. A portamento effect can also be achieved by the embodiment of FIG. 20. In FIG. 20, the voice keying system further comprises the portamento frequency detector 92 of FIG. 19 and a portamento oscillator 93 and a switch 94. When the frequency of the input signal is largely changing in accordance with a portamento, the switch 94 is changed over to the output of the portament oscillator 93 by means of the control output of the frequency detector 92, so that the portamento oscillator 93 generates an output tone signal having portamento effect at the output terminal 3. When the frequency settles down, the switch 94 is changed over to the output of the tone generator 2, so that the tone generator generates an output tone signal the frequency of which is settled down.

The voice keying system can easily be tuned before playing by connecting an earphone to the output terminal 3.

In the embodiments described hereinbefore, the memory means 5 is connected between the frequency responding means 1 and the tone generator 2. The memory means 5 may be connected to the other part of the voice keying system of the present invention. In the embodiment of FIGS. 4 or 8, the memory means 5 may be connected between the encoder 15 (or 76) and the programmable counter (or variable divider) 25.

As described hereinbefore, the voice keying system of the present invention can generate output tone signals having a discretely exact frequency or having a little frequency fluctuation and having a very exact tone interval, even if a player sings more or less with an aberration of pitch and of tone interval. Therefore, the player can easily play the musical instrument having the voice keying system of the present invention without any special effort for performance.

Further, the voice keying system of the present invention can widely be used for processing any monophonic signal from an electric guitar, other electric or electronic musical instrument, a tape recorder, a phonograph, a radio, a television, etc., as an input signal other than a vocal tone. The voice keying system of the present invention is very usable because it can produce an output tone signal the frequency of which is multiplied or divided as well as an output tone signal having nearly the same frequency as the input signal. The voice keying system is also very usable for reforming or training of the music sense of a man who cannot keep pitch. By adding a memory means, the voice keying system of the present invention can produce an output signal even after the input signal ceases. Therefore, it is very easy to play and it can produce an output signal having various amplitude envelopes other than the input signal. Thus, the voice keying system of the present invention is much superior in its effects to the conventional voice controlled musical instrument.

While a particular embodiment of the present invention is described hereinbefore, it will be apparent that various modifications can be made in the form and construction thereof without departing from the fundamental principles of the present invention. It is, therefore, desired by the following claims, to include within the scope of the present invention all similar and modified forms of the apparatus disclosed, and by which the results of the invention can be obtained.

What is claimed is:

1. A voice keying system for a voice controlled musical instrument, comprising: a frequency responding means for responding to an input signal of audio frequency and generating a control signal which corresponds to each of a plurality of frequency bands of the input signal, said plurality of frequency bands corresponding to a plurality of notes of a musical scale, respectively, each of said frequency bands having a frequency range which covers approximately a tone interval of a half-tone of said musical scale, and a center frequency of each of said frequency bands being predetermined so as to correspond approximately to the frequency of each of said notes of the musical scale; a memory means coupled to said frequency responding means for storing the control signal; and a tone generator means coupled to the output of said frequency responding means for generating an output tone signal in response to said control signal, said output tone signal corresponding to the respective notes of the musical scale, whereby said output tone signal has less frequency errors and less frequency fluctuation than said input audio frequency signal within said frequency bands, respectively.

2. A voice keying system as claimed in claim 1 wherein said tone generator means comprises means for generating output tone signals having no frequency errors of frequency fluctuations within said frequency bands, respectively.

3. A voice keying system as claimed in claim 1 wherein said tone generator means comprises means for generating output tone signals only in frequency bands narrower than each of said frequency bands for which control signals are generated, whereby there exist narrow frequency band boundaries between adjacent frequency bands in which no signals are generated.

4. A voice keying system as claimed in claim 1 wherein said tone generator means comprises means for generating two output signals at a narrow frequency zone narrower in frequency than each of said frequency bands and existing at every boundary between adjacent frequency bands.

5. A voice keying system as claimed in claim 1 wherein said output tone signals have more frequency error or frequency fluctuation than that of said input audio frequency signals at a frequency zone narrower in frequency than each of said frequency bands and existing at every boundary between adjacent frequencies.

6. A voice keying system as claimed in claim 1 wherein said tone generator means comprises means for generating an output tone signal which is one of a P-multiple and 1/P-multiple, where P = any real number of the frequencies of each of said notes of the musical scale.

7. A voice keying system as claimed in claim 1 wherein said tone generator means comprises means for generating a plurality of output tone signals which are from among tone signals which are a P-multiple and 1/P multiple, where P = any real number, of the frequencies of each of said notes of the musical scale.

8. A voice keying system as claimed in claim 7 wherein P is an integer.

9. A voice keying system as claimed in claim 7 wherein said plurality of output tone signals are in octave relation to each other.

10. A voice keying system as claimed in claim 1 wherein said frequency responding means comprises means for generating a plurality of control signals and has a plurality of output terminals for the respective control signals.

11. A voice keying system as claimed in claim 10 wherein said tone generator comprises a high frequency oscillator means for generating a high frequency signal having a much higher frequency than said input audio frequency signals, a logic code generator for producing logic codes in response to said control signals, and a programmable counter coupled to said logic code generator and said high frequency oscillator means for dividing said high frequency signal so as to generate an output tone signal in response to one of said logic codes.

12. A voice keying system as claimed in claim 10 wherein said frequency responding means comprises a frequency to voltage converter for converting the frequency of said input signal into a d.c. voltage, and a threshold circuit coupled to said frequency to voltage converter for generating a plurality of control signals in the form of equal voltages at said plurality of output terminals, said control signals controlling said tone generator means.

13. A voice keying system as claimed in claim 1 wherein said frequency responding means comprises a frequency to voltage converter means which converts an input audio frequency to a voltage which changes in accordance with a change of the frequency of said input signals, said voltage being derived as said control signal at the output of said frequency responding means, said control signal in the form of voltage being applied to said tone generator means for controlling the frequency thereof, said tone generator means being comprised of a plurality of oscillators for generating notes of the musical scale, and a plurality of threshold gates coupled to said oscillators, each of which opens in response to a corresponding one of a plurality of different ranges of said control signal in voltage form so as to pass the respective notes of the musical scale from the corresponding oscillator as an output tone signal.

14. A voice keying system as claimed in claim 1 wherein said memory means comprises means for a logic code as a control signal in response to each output of said plurality of frequency bands, said tone generator means comprising means controlled by logic codes.

15. A voice keying system as claimed in claim 14 wherein said tone generator means comprises a high frequency oscillator for generating a high frequency signal having a much higher frequency than said input audio frequency signals, and a programmable counter for dividing said high frequency signal so as to generate an output tone signal in response to said logic code.

16. A voice keying system as claimed in claim 14 wherein said tone generator means is a programmable counter type and said frequency responding means comprises a frequency to voltage converter for producing a d.c. voltage changing in accordance with the change of the frequency of said input audio frequency signal, a threshold circuit coupled to said counter for generating in response to said d.c. voltage a plurality of voltage signals having equal voltages and a logic code generator coupled to said threshold circuit for generating said voltage signals into logic codes for controlling said tone generator means.

17. A voice keying system as claimed in claim 14 wherein said frequency responding means comprises a plurality of band pass filters for filtering said input signal so as to produce output signals at the respective output terminals thereof, a selecting circuit connected to said band pass filters for selecting and producing one output signal corresponding to the frequency band of said input audio frequency signal, and a logic code generator connected to said selecting circuit for generating a logic code in response to said one output signal, said logic code controlling said tone generator means.

18. A voice keying system as claimed in claim 14 wherein said frequency responding means comprises a counter for counting a period of the input signal of audio frequency, a threshold memory circuit for memorizing logic information representing frequency boundaries of said frequency bands in the form of corresponding periods of said frequency boundaries, and comparator means coupled to said counter and to said threshold memory circuit for comparing the output count of said counter with said logic information and generating a logic code as said control signal in response to each of said plurality of frequency bands, said logic code controlling said tone generator means.

19. A voice keying system as claimed in claim 1 wherein said voice keying system further comprises a frequency tuning means operatively coupled to said frequency responding means and to said tone generator means for tuning both said frequency bands and the frequency of said tone generator means synchronously with each other.

20. A voice keying system as claimed in claim 1 wherein said voice keying system further comprises a frequency fluctuation detector coupled to said frequency responding means for detecting the frequency fluctuation of the input audio frequency signal and for generating a fluctuation signal which modulates the frequency of said output tone signal.

21. A voice keying system as claimed in claim 1 wherein said voice keying system further comprises a portamento frequency detector coupled to said frequency responding means for detecting portamento frequency of said input audio frequency signal in the form of voltage which controls the frequency of said output tone signal so as to provide said output tone signal with portamento.

22. A voice keying system as claimed in claim 1 wherein said voice keying system further comprises a portamento frequency detector coupled to said frequency responding means for detecting portamento frequency of said input signal, a portamento oscillator for oscillating another output tone signal having portamento effect in response to the output of said portamento frequency detector and a switch connected to the output of said tone generator and said portamento oscillator for changing over the output terminal to the output of said portamento oscillator during the time the frequency of said input signal is changing in accordance with a portamento of large tone interval and then changing over the output terminal to the output of said tone generator after the frequency of said input audio frequency signal is settled down.

* * * * *